US010177485B2

(12) United States Patent
Ono et al.

(10) Patent No.: US 10,177,485 B2
(45) Date of Patent: Jan. 8, 2019

(54) ELECTRICAL CONNECTOR AND METHOD FOR MANUFACTURING SAME

(71) Applicant: SMK Corporation, Tokyo (JP)

(72) Inventors: Naoyuki Ono, Chiba (JP); Osamu Hayashi, Kanagawa (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 15/658,393

(22) Filed: Jul. 25, 2017

(65) Prior Publication Data

US 2018/0048088 A1 Feb. 15, 2018

(30) Foreign Application Priority Data

Aug. 10, 2016 (JP) ..... 2016-157911

(51) Int. Cl.

| | |
|---|---|
| ***H01R 13/52*** | (2006.01) |
| ***H01R 43/18*** | (2006.01) |
| ***H01R 43/20*** | (2006.01) |
| *H01R 24/28* | (2011.01) |
| *H01R 24/60* | (2011.01) |

(Continued)

(52) U.S. Cl.

CPC ..... *H01R 13/5202* (2013.01); *H01R 13/5213* (2013.01); *H01R 43/18* (2013.01); *H01R 43/20* (2013.01); *H01R 13/6594* (2013.01); *H01R 24/28* (2013.01); *H01R 24/60* (2013.01); *H01R 2107/00* (2013.01)

(58) Field of Classification Search

CPC .... H01R 2107/00; H01R 24/60; H01R 24/28; H01R 13/6594; H01R 43/20; H01R 43/18; H01R 13/5213; H01R 13/5202; G01R 13/5202

USPC ..... 439/607.35–37

See application file for complete search history.

(56) References Cited

U.S. PATENT DOCUMENTS

| | | | | |
|---|---|---|---|---|
| 2012/0108095 | A1* | 5/2012 | Liu | H01R 13/5219 439/271 |
| 2015/0255905 | A1* | 9/2015 | Little | H01R 13/6658 439/78 |
| 2017/0324187 | A1* | 11/2017 | Zhu | H01R 13/5202 |

FOREIGN PATENT DOCUMENTS

| | | | |
|---|---|---|---|
| JP | H08-57642 | A | 3/1996 |
| JP | 2002-035956 | A | 2/2002 |
| JP | 2012-009357 | A | 1/2012 |

OTHER PUBLICATIONS

Office Action issued for counterpart Japanese Application 2016-157911, issued by the Japan Patent Office dated Mar. 28, 2017.

(Continued)

*Primary Examiner* — Renee Luebke
*Assistant Examiner* — Paul Baillargeon

(57) ABSTRACT

An electrical connector includes: a cylindrical metal shell having a mating portion extended from the front end to the rear end; and an inner sealing member that is brought into contact with a housing and the metal shell and hermetically seals between the housing and the metal shell. The mating portion is sealed by an outer peripheral joint and an inner peripheral joint so as to prevent the flow of a liquid from the front end side to the rear end side. Here, the outer peripheral joint is formed to some midpoint from the outer peripheral surface of the metal shell toward the inner peripheral surface of the metal shell, and the inner peripheral joint is formed from the inner peripheral surface to the outer peripheral joint on the contact portion with the inner sealing member.

8 Claims, 8 Drawing Sheets

(51) Int. Cl.
*H01R 107/00* (2006.01)
*H01R 13/6594* (2011.01)

(56) References Cited

OTHER PUBLICATIONS

Office Action issued for counterpart Japanese Application 2016-157911, issued by the Japan Patent Office dated Jul. 11, 2017.

* cited by examiner

ELECTRICAL CONNECTOR AND METHOD FOR MANUFACTURING SAME

CROSS REFERENCE TO RELATED APPLICATION

The contents of the following Japanese patent application are incorporated herein by reference, Japanese Patent Application No. 2016-157911 filed on Aug. 10, 2016.

FIELD

The present invention relates to an electrical connector having a waterproof function and a method for manufacturing the same.

BACKGROUND

Conventionally known as an electrical connector having a waterproof function is one configured such that a housing is inserted into a metal shell into which a mating connector is inserted, and a sealing member is employed between the metal shell and the housing for waterproof. Such a metal shell is formed by bending a metal plate, and the joint of both edges of the metal plate butting against each other is welded, so as to fill the gap that would otherwise occur along the joint.

Disclosed in Patent Literature 1 is an electrical connector in which the joint of both edges of a metal plate butting against each other is laser welded to form a metal shell, thereby preventing the entry of water or the like through the joint.

CITATION LIST

Patent Literature

Patent Literature 1: Japanese Patent Application Laid-Open No. 2012-009357

SUMMARY

Technical Problem

However, in Patent Literature 1, to weld the joint so that no gap is found in the entire plate thickness direction of the metal shell, a high laser output is required, which causes large asperities on the surface of the joint to be irradiated with a laser beam. This may lead to degradation in ease of attachment to a device or the like and defile the outer appearance. Furthermore, in Patent Literature 1, when the laser output is reduced in order to minimize the asperities that would be otherwise produced by welding on the surface of the joint, a gap on the surface opposite to the surface of the joint to be irradiated with a laser beam cannot be sealed, causing considerable degradation in the waterproof function. As described above, in Patent Literature 1, in order to weld the joint so that the asperities to be produced by welding on the surface of the joint are minimized and no gap is found in the entire plate thickness direction, fine control is required of the laser output, which makes manufacturing difficult.

An object of the present invention is to provide an electrical connector and a method for manufacturing the electrical connector which enables the mating portion of a metal shell to be made waterproof without using an advanced technique, thereby reducing manufacturing costs and offering low prices while implementing reliable waterproofness.

Solution to Problem

An electrical connector according to an aspect of the present invention includes: an electrically conductive contact; an insulating housing configured to hold the contact; a cylindrical metal shell including an insertion hole and a mating portion extended from a front end to a rear end of the metal shell, the insertion hole penetrating in a back-and-forth direction to allow a mating connector to be inserted therein from the front and configured to accommodate the housing; and an inner sealing member configured to be brought into contact with the housing and the metal shell so as to hermetically seal between the housing and the metal shell, wherein the mating portion is sealed by an outer peripheral joint and an inner peripheral joint to prevent a flow of a liquid from the front end to the rear end, the outer peripheral joint being formed to some midpoint from an outer peripheral surface of the metal shell toward an inner peripheral surface of the metal shell, the inner peripheral joint having at least part of a rearward side formed from the inner peripheral surface to the outer peripheral joint on a contact portion with the inner sealing member.

On the contact portion with the sealing member, the outer peripheral joint and the inner peripheral joint can seal the mating portion to thereby eliminate a gap of the mating portion. A liquid such as water that has entered into the insertion hole from the front of the insertion hole of the metal shell is prevented from entering through the gap further into the device to which the electrical connector is attached.

A method for manufacturing the electrical connector according to an aspect of the present invention has the steps of: bending a metal plate and bringing both ends of the metal plate into contact with each other to thereby form a cylindrical metal shell which is penetrated in a back-and-forth direction to allow a mating connector to be inserted therein from a front thereof; sealing a mating portion of both the ends of the metal shell to some midpoint from an outer peripheral surface of the metal shell toward an inner peripheral surface of the metal shell; sealing the mating portion from the inner peripheral surface toward the outer peripheral surface to thereby form a blocking portion on at least part of a rearward side, the blocking portion sealing the mating portion in an entire plate thickness direction, thereby allowing for preventing a flow of a liquid on the mating portion from a front end side to a rear end side; and inserting a housing configured to hold an electrically conductive contact into the metal shell, so that an inner sealing member hermetically seals between the housing into which the metal shell has been inserted and the metal shell, and the inner sealing member is brought into contact with the blocking portion.

On the contact portion with the sealing member, a blocking portion configured to seal the mating portion in the entire plate thickness direction is formed to thereby eliminate a gap of the mating portion. A liquid such as water that has entered into the metal shell from the front of the metal shell is prevented from entering through the gap further into the device to which the electrical connector is attached.

The aspect of the present invention allows the mating portion of the metal shell to be made waterproof without using an advanced technique, thereby reducing manufacturing costs and offering low prices while implementing reliable waterproofness.

DESCRIPTION OF EMBODIMENTS

Figure 1:
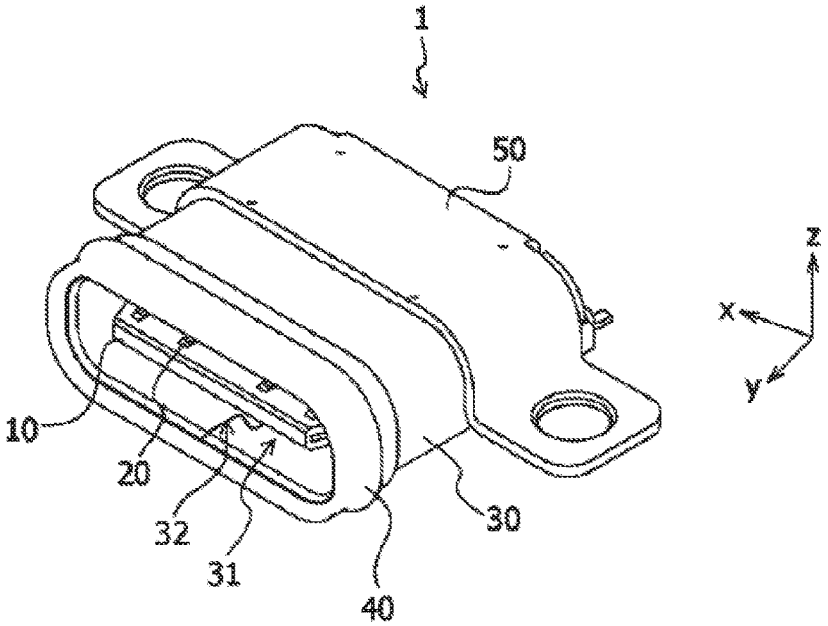
FIG. 1 is a perspective view illustrating an electrical connector according to an embodiment of the present invention.
Figure 2:
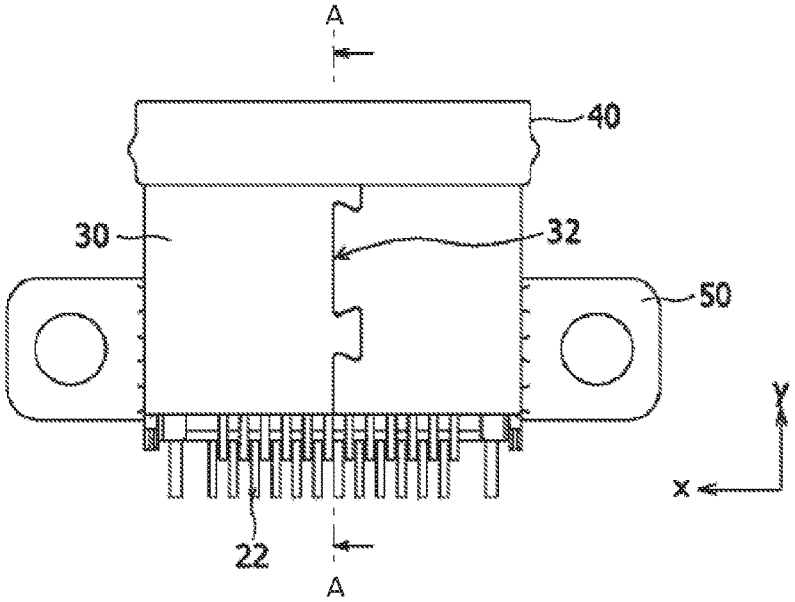
FIG. 2 is a bottom view illustrating the electrical connector according to the embodiment of the present invention.
Figure 3:
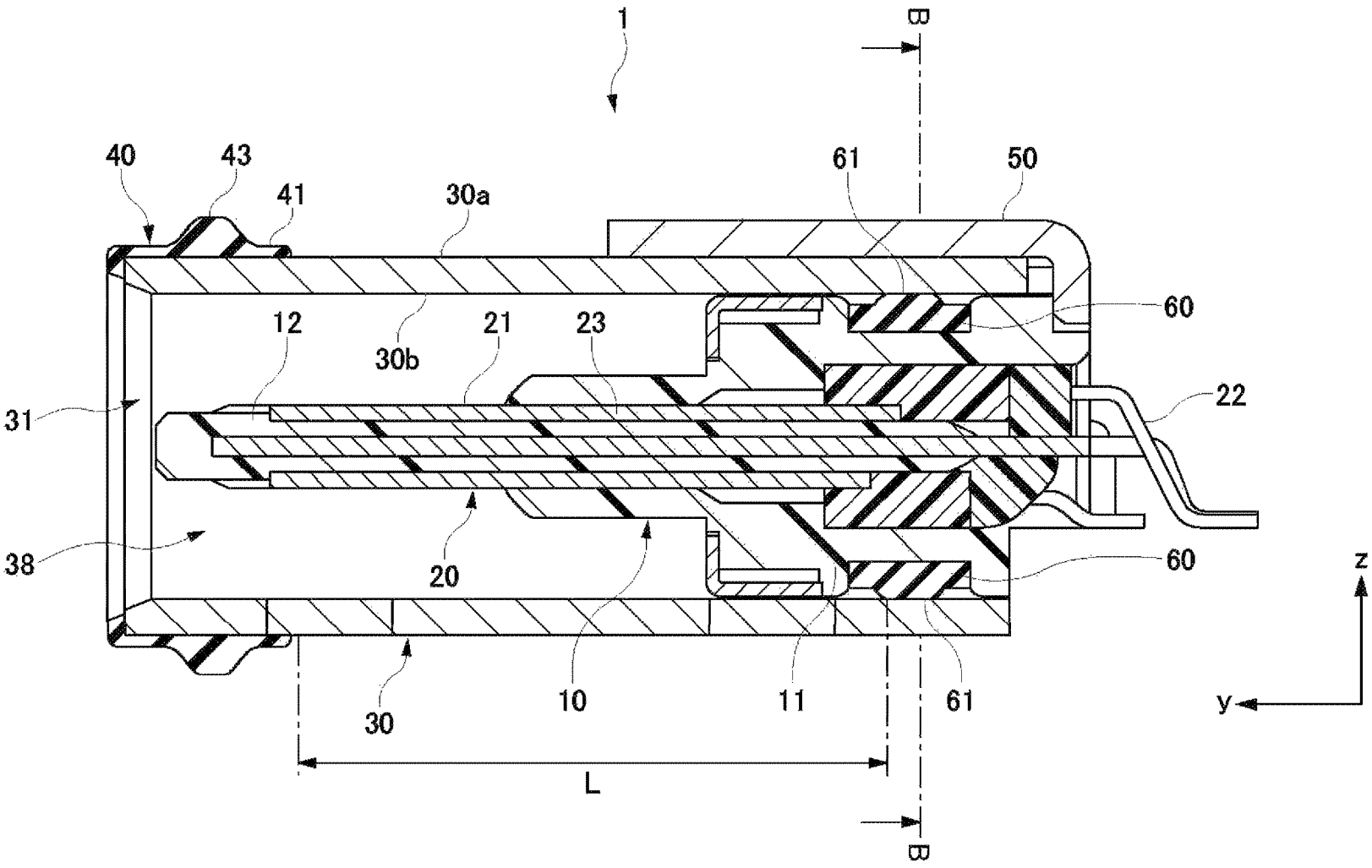
FIG. 3 is a cross-sectional view taken along line A-A of FIG. 2.
Figure 4:
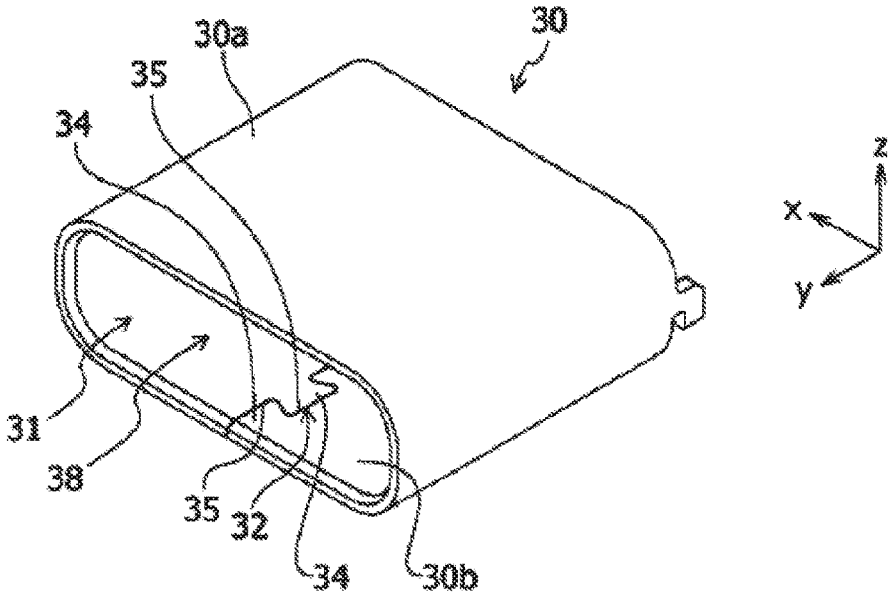
FIG. 4 is a perspective view illustrating a metal shell according to the embodiment of the present invention when viewed in front thereof diagonally from above.
Figure 5:
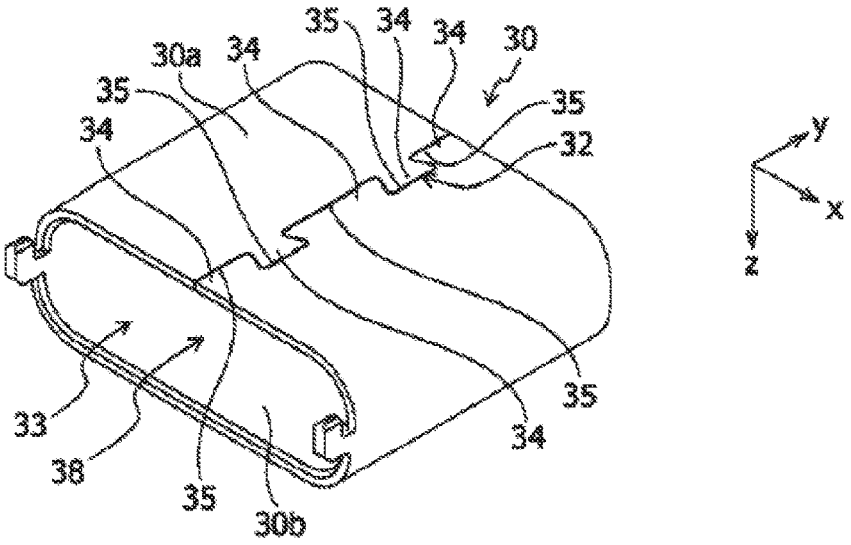
FIG. 5 is a perspective view illustrating the metal shell according to the embodiment of the present invention when viewed in back thereof diagonally from below.
Figure 6:
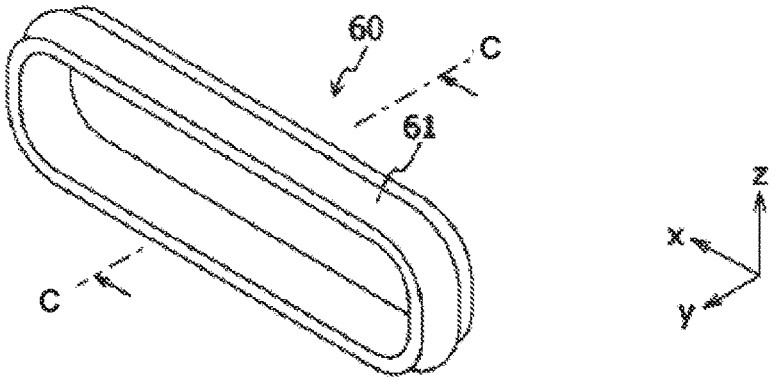
FIG. 6 is a perspective view illustrating a sealing member according to the embodiment of the present invention.
Figure 7:
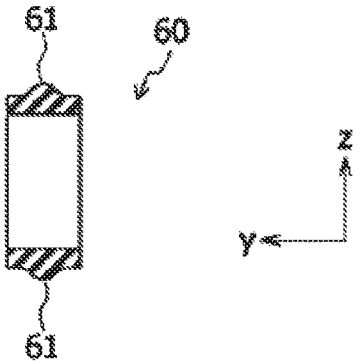
FIG. 7 is a cross-sectional view taken along line C-C of FIG. 6.

Now, with reference to the drawings as appropriate, an electrical connector according to an embodiment of the present invention will be described in more detail. In the drawings, a description will be given assuming that the x-axis, the y-axis, and the z-axis constitute the three-axis rectangular coordinate system; the positive direction of the y-axis is referred to as the front direction, the negative direction of the y-axis as the rear direction, the x-axis direction as the right-and-left direction, the positive direction of the z-axis as the upward direction, and the negative direction of the z-axis as the downward direction.

<Configuration of Electrical Connector>

Figure 8:
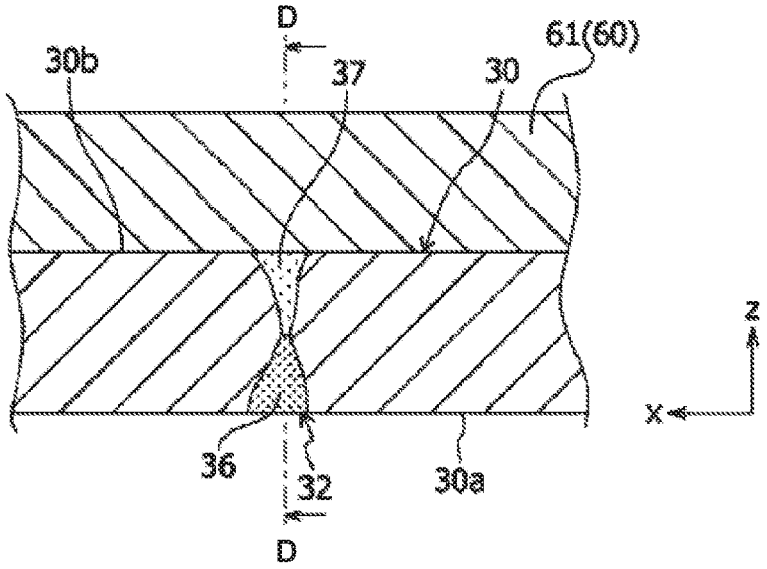
FIG. 8 is a cross-sectional view taken along line B-B of FIG. 3.

With reference to FIG. 1 to FIG. 8, the configuration of the electrical connector 1 according to an embodiment of the present invention will be described in detail below. Note that FIG. 8 is an enlarged view illustrating part of a cross-sectional view taken along line B-B of FIG. 3.

The electrical connector 1 has a housing 10, contacts 20, a metal shell 30, an outer sealing member 40, a subframe 50, and an inner sealing member 60.

The housing 10 is formed of an insulating material and holds the contacts 20. The housing 10 includes a main body 11 and a projected part 12.

The main body 11 has the inner sealing member 60 attached thereto. The main body 11 is press fitted into and thereby secured to the metal shell 30. Note that the means for securing the main body 11 to the metal shell 30 is not limited to the press fitting, but the engagement and the like method may also be employed.

The projected part 12 is protruded frontward from the front end of the main body 11 and mates with a mating connector (not shown).

The contacts 20 are formed of an electrically conductive material, and provided with a connection 21, a terminal 22, and a secured portion 23.

The connection 21 is exposed to the surface of the projected part 12 and can be connected to a contact of a mating connector.

The terminal 22 is protruded rearward from the rear end of the main body 11 and soldered and thereby connected to an electrically conductive portion of a circuit board (not shown).

The secured portion 23 is secured to the main body 11 by integral molding. The means for securing the secured portion 23 to the main body 11 is not limited to the integral molding, but the press fitting or the engagement may also be employed.

The metal shell 30 is formed of an electrically conductive material and includes a mating portion 32 and an insertion hole 38.

The mating portion 32 is formed by abutting both ends of the metal plate forming the metal shell 30 against each other, and extended from the front end to the rear end. The mating portion 32 is formed by a projected end portion 34 being engaged with a recessed portion 35. As shown in FIG. 8, the mating portion 32 is sealed by an outer peripheral joint 36 and an inner peripheral joint 37 so as to prevent the flow of a liquid from the front end side to the rear end side. Here, the outer peripheral joint 36 is formed to some midpoint from the outer peripheral surface 30*a* of the metal shell 30 toward the inner peripheral surface 30*b* of the metal shell 30, and the inner peripheral joint 37 is formed from the inner peripheral surface 30*b* to the outer peripheral joint 36 on a contact portion with a contact portion 61 of the inner sealing member 60. The outer peripheral joint 36 is formed from the front end to the rear end of the mating portion 32, or from the rear end of the outer sealing member 40 to the front end of the contact portion 61 of the inner sealing member 60 (within the range L of FIG. 3). Note that in FIG. 8, for convenience of explanation, the boundary between the outer peripheral joint 36/the inner peripheral joint 37 and the metal shell 30 is clearly illustrated. However, in practice, the boundary between the outer peripheral joint 36/the inner peripheral joint 37 and the metal shell 30 is ambiguous.

The insertion hole 38 has the front end opened to outside through a front end opening 31 and the rear end opened to outside through a rear end opening 33. The insertion hole 38, which penetrates in the back-and-forth direction, allows a mating connector (not shown) to be inserted from the front and accommodates the housing 10 that holds the contacts 20.

The outer sealing member 40, which is formed of an elastic material, is provided on the metal shell 30 and has a mounting part 41 and a pressure contact part 43.

The mounting part 41 is attached to the outer peripheral surface 30*a* of the metal shell 30 toward the front thereof. The mounting part 41 is provided with the pressure contact part 43 which is protruded outwardly and which is brought into pressure contact with the enclosure of the device as a pressure contact object in the up-and-down and right-and-left directions.

The subframe 50 is provided on the rear side of the outer peripheral surface 30*a* of the metal shell 30 and attached to the enclosure of the device. Note that the electrical connector 1 may not have to include the subframe 50.

The inner sealing member 60, which is formed of an elastic material, is attached to the housing 10 and is brought into contact with the housing 10 and the metal shell 30, thereby hermetically sealing between the housing 10 and the metal shell 30. The inner sealing member 60 is provided, along the outer peripheral surface, with the contact portion 61 that is brought into contact with the inner peripheral surface 30*b* of the metal shell 30 and the mating portion 32. The contact portion 61 is protruded outwardly in the inner sealing member 60.

<Method for Manufacturing Electrical Connector>

With reference to FIG. 9 to FIG. 12, a method for manufacturing the electrical connector 1 according to the embodiment of the present invention will be described in detail below. Note that in FIG. 10, for convenience of explanation, the boundary between the outer peripheral joint 36/the inner peripheral joint 37 and the metal shell 30 is clearly illustrated. However, in practice, the boundary between the outer peripheral joint 36/the inner peripheral joint 37 and the metal shell 30 is ambiguous.

First, the contacts 20 having been prepared in advance are secured to the housing 10 by integral molding. This allows the secured portions 23 of the contacts 20 to be secured to the main body 11 of the housing 10, so that the connections 21 of the contacts 20 are exposed to the surface of the projected part 12 of the housing 10, and the terminals 22 of the contacts 20 are protruded to outside from the main body 11.

Figure 9:
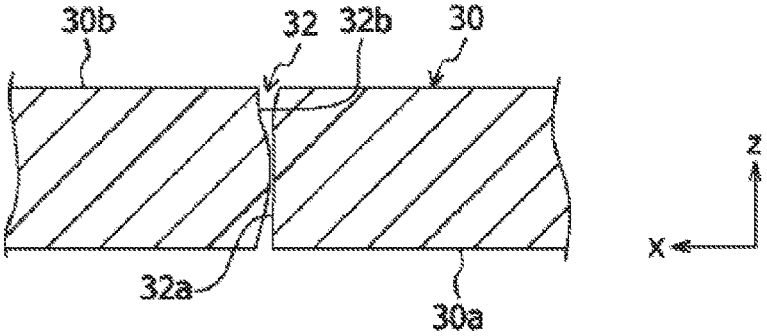
FIG. 9 is a view illustrating the metal shell according to the embodiment of the present invention in a bent state.

Furthermore, the metal plate is bent to abut both ends of the metal plate against each other, thereby forming the cylindrical metal shell 30. This mating portion 32 is formed in this manner. At this time, as shown in FIG. 9, due to dimensional tolerances for cutting the metal plate, there has occurred a gap between an end 32*a* and an end 32*b* of the metal shell 30 that constitute the mating portion 32.

Figure 10:
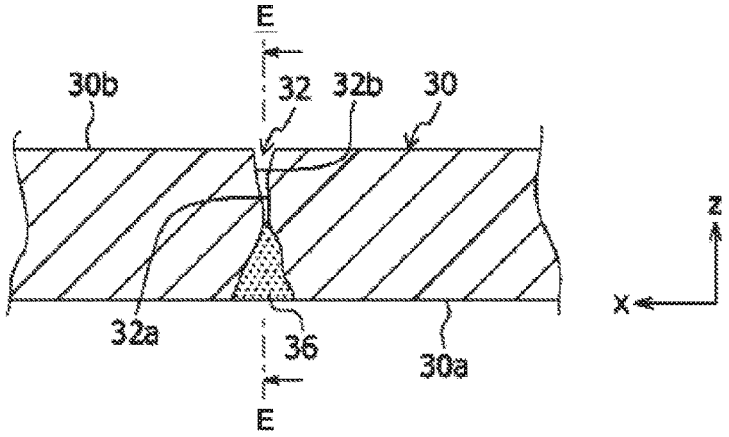
FIG. 10 is a view illustrating the mating portion of the metal shell according to the embodiment of the present invention in a state of being welded on the outer peripheral surface side.

Next, as shown in FIG. 10, the mating portion 32 is irradiated with a laser beam from below outside the metal shell 30 so as to weld and thereby seal the front end to the rear end of the mating portion 32 or the rear end of the outer sealing member 40 to the front end of the contact portion 61 of the inner sealing member 60 to some midpoint from the outer peripheral surface 30*a* of the metal shell 30 toward the inner peripheral surface 30*b* of the metal shell 30. In this manner, the outer peripheral joint 36 which has been welded is formed. At this time, the metal shell 30 irradiated with the laser beam gradually diffuses heat in the back-and-forth direction while being melted, allowing the heat to be gradually diffused from the outer peripheral surface 30*a* of the metal shell 30 toward the inner peripheral surface 30*b*. Thus, the outer peripheral joint 36 is decreased in size with increasing distance from the light source of the laser beam (or with increasing proximity to the inner peripheral surface 30*b*.)

Figure 11:
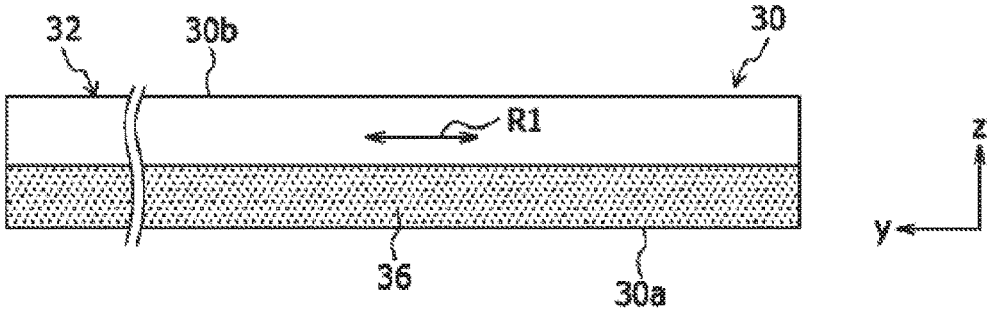
FIG. 11 is a cross-sectional view taken along line E-E of FIG. 10.

In this state, as shown in FIG. 11, since the mating portion 32 includes a gap extended from the front end to the rear end of the metal shell 30 toward the inner peripheral surface 30*b*, the gap acts as a water passage R1. Thus, a liquid such as water enters into the device, to which the electrical connector 1 is attached, via the water passage R1 from outside the electrical connector 1, thus impairing the waterproof function.

Next, the mating portion 32 is irradiated with a laser beam from above or inside the metal shell 30 and from back so as to weld and thereby seal the mating portion 32 from the inner peripheral surface 30*b* toward the outer peripheral surface 30*a*, thereby forming the inner peripheral joint 37. In this manner a blocking portion 39 configured to seal the entire mating portion 32 in the plate thickness direction by the outer peripheral joint 36 and the inner peripheral joint 37 is formed. At this time, the metal shell 30 irradiated with the laser beam gradually diffuses heat in the back-and-forth direction while being melted, allowing the heat to be gradually diffused from the inner peripheral surface 30*b* of the metal shell 30 toward the outer peripheral surface 30*a*. Thus, the inner peripheral joint 37 is decreased in size with increasing distance from the light source of the laser beam (or with increasing proximity to the outer peripheral surface 30*a*).

Figure 12:
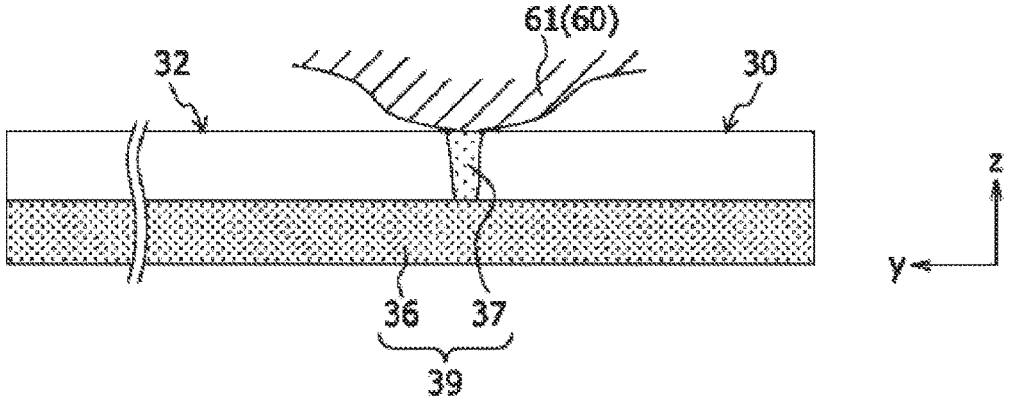
FIG. 12 is a cross-sectional view taken along line D-D of FIG. 8.

In this state, as shown in FIG. 12, the water passage R1 is sealed by the inner peripheral joint 37. Thus, it is possible to prevent the entry of a liquid into the device, to which the electrical connector 1 is attached, via the water passage R1 from outside the electrical connector 1 and prevent the flow of the liquid from the front end side to the rear end side on the mating portion 32. Furthermore, at this time, the inner peripheral joint 37 is formed on the rear side of the mating portion 32. This enables the mating portion 32 to be readily irradiated with a laser beam through the rear end opening 33 of the metal shell 30, thus facilitating the welding and the manufacturing of the same.

Next, the housing 10 holding the contacts 20 is inserted into the metal shell 30, and then the inner sealing member 60 hermetically seals between the housing 10 having been inserted into the metal shell 30 and the metal shell 30, and the contact portion 61 of the inner sealing member 60 is brought into contact with the blocking portion 39.

Then, the outer sealing member 40 is attached to the front end of the metal shell 30, thereby completing the electrical connector 1.

In the electrical connector 1 manufactured in this manner, a liquid having entered from outside into the metal shell 30 through the front thereof is prevented from entering rearward by the contact portion 61 of the inner sealing member 60 and prevented from entering rearward by the blocking portion 39 of the mating portion 32. This makes it possible to acquire a waterproof function for the device to which the electrical connector 1 is attached.

As described above, according to this embodiment, the inner sealing member 60 is provided which is brought into contact with the housing 10 and the metal shell 30 so as to hermetically seal between the housing 10 and the metal shell 30. The mating portion 32 is sealed by the outer peripheral joint 36 and the inner peripheral joint 37 to prevent the flow of a liquid from the front end side to the rear end side. Here, the outer peripheral joint 36 is formed to some midpoint from the outer peripheral surface 30*a* of the metal shell 30 toward the inner peripheral surface 30*b* of the metal shell 30, and the inner peripheral joint 37 is formed from the inner peripheral surface 30*b* to the outer peripheral joint 36 on the contact portion with the inner sealing member 60. This allows the mating portion of the metal shell to be made waterproof without using an advanced technique, thereby reducing manufacturing costs and offering low prices while implementing reliable waterproofness.

Furthermore, according to this embodiment, the metal plate is bent so as to bring the end 32*a* and the end 32*b* of the metal plate into contact with each other to thereby form the cylindrical metal shell 30 which is penetrated in the back-and-forth direction and which allows a mating connector to be inserted therein from the front. The mating portion 32 of the end 32*a* and the end 32*b* of the metal shell 30 is sealed to some midpoint from the outer peripheral surface 30*a* of the metal shell 30 toward the inner peripheral surface 30*b* of the metal shell 30 so as to seal the mating portion 32 from the inner peripheral surface 30*b* toward the outer peripheral surface 30*a*. This allows for forming the blocking portion 39 that seals the mating portion 32 in the entire plate thickness direction so as to prevent the flow of a liquid from the front end side to the rear end side on the mating portion 32. The housing 10 holding the electrically conductive contacts 20 is inserted into the metal shell 30 to hermetically seal between the housing 10 inserted into the metal shell 30 and the metal shell 30 by means of the inner sealing member 60, and the inner sealing member 60 is brought into contact with the blocking portion 39. This allows the mating portion of the metal shell to be made waterproof without using an advanced technique, thereby reducing manufacturing costs and offering low prices while implementing reliable waterproofness.

Furthermore, according to this embodiment, the mating portion 32 is welded, thereby seal the mating portion 32 with reliability.

Furthermore, according to this embodiment, the mating portion 32 is irradiated with a laser beam from both inside and outside the metal shell 30, thereby eliminating the necessity of providing a high output laser beam. This makes it possible to minimize the asperities to be otherwise formed by welding on the surface of the metal shell 30. Fine control needs not to be provided to the laser beam output, thereby facilitating manufacturing and thus reducing manufacturing costs.

Furthermore, according to this embodiment, when the outer peripheral joint 36 is formed for the mating portion 32 from the rear end of the outer sealing member 40 to the front end of the contact portion 61 of the inner sealing member 60, the outer peripheral joint 36 can be formed in a smaller range as compared with the case in which the outer peripheral joint 36 is formed from the front end to the rear end of the mating portion 32. It is thus possible to facilitate manufacturing and thus reduce manufacturing costs.

Furthermore, according to this embodiment, the outer sealing member 40 is provided toward the front of the outer periphery of the metal shell 30, and the outer peripheral joint 36 is formed from the rear end of the outer sealing member 40 of the mating portion 32 to the front end of the contact portion 61 of the inner sealing member 60. This enables the front end of the mating portion 32, on which the outer peripheral joint 36 is not formed, to be made waterproof by the outer sealing member 40.

Note that in the present invention, the type, the placement, and the number of the members are not limited to the aforementioned embodiments, but as a matter of course, may also be changed, as appropriate, without departing from the scope and spirit of the invention, for example, by replacing the components with those that have the same operational effects, as appropriate.

More specifically, in the aforementioned embodiment, the mating portion 32 is welded to seal, but the mating portion 32 may also sealed by an adhesive.

Furthermore, in the aforementioned embodiment, the blocking portion 39 is formed on the mating portion 32 that is in contact with the contact portion 61 of the inner sealing member 60. However, a blocking portion may also be formed from the front end to the rear end of the mating portion 32 so as to seal from the front end to the rear end of the mating portion 32 in the entire plate thickness direction. Thus, at least the blocking portion 39 may only have to be formed on the mating portion 32 that is in contact with the contact portion 61.

Furthermore, in the aforementioned embodiment, the contact portion 61 is provided on the inner sealing member 60, but an inner sealing member 60 that does not have the contact portion 61 may also be brought into contact with the blocking portion 39.

Furthermore, in the aforementioned embodiment, one contact portion 61 is provided for the inner sealing member 60, but a plurality of contact portions may also be provided for the inner sealing member in the back-and-forth direction, so that a blocking portion may be formed on the mating portion with which each contact portion is in contact.

Furthermore, in the aforementioned embodiment, the shape and placement of the housing 10 and the contacts 20 may be arbitrarily determined, and the number of contacts 20 may also be arbitrarily determined.

The embodiment of the present invention is preferred to an electrical connector that is provided with a waterproof function and a method for manufacturing the same.

REFERENCE SIGNS LIST

1 electrical connector
10 housing
11 main body
12 projected part
20 contact
21 connection
22 terminal
23 secured portion
30 metal shell
30*a* outer peripheral surface
30*b* inner peripheral surface
31 front end opening
32 mating portion
32*a* end
32*b* end
33 rear end opening
34 projected end portion
35 recessed portion
36 outer peripheral joint
37 inner peripheral joint
38 insertion hole
39 blocking portion
40 outer sealing member
41 mounting part
43 pressure contact part
50 subframe
60 inner sealing member
61 contact portion

The invention claimed is:

1. An electrical connector comprising:

an electrically conductive contact;

an insulating housing configured to hold the contact;

a cylindrical metal shell including an insertion hole and a lengthwise mating portion extended from an open front end of the metal shell to an opposite open rear end of the metal shell, the insertion hole penetrating in a back-and-forth direction to allow a mating connector to be inserted therein from the front and configured to accommodate the housing; and an inner sealing member configured to be brought into contact with the housing and the metal shell so as to hermetically seal between the housing and the metal shell, wherein the lengthwise mating portion is sealed by an outer peripheral joint and an inner peripheral joint to prevent a flow of a liquid from the open front end of the metal shell to the open rear end of the metal shell, the outer peripheral joint being formed from the front end to the rear end of the metal shell, and to some midpoint from an outer peripheral surface of the metal shell toward an inner peripheral surface of the metal shell, the inner peripheral joint not being formed along an entire length of the lengthwise mating portion and having at least part formed at a point of contact of the lengthwise mating portion with the inner sealing member, and from the inner peripheral surface to the outer peripheral joint, and the contact portion is located on a rearward side of the mating portion.

2. The electrical connector according to claim 1, wherein the inner peripheral joint and the outer peripheral joint are welded at a point where the inner peripheral joint contacts the contact portion.

3. The electrical connector according to claim 1, further comprising an outer sealing member provided toward a front of the outer peripheral surface of the metal shell, wherein the outer peripheral joint seals from a rear end of the outer sealing member to a front end of the contact portion.

4. The electrical connector according to claim 1, wherein the lengthwise mating portion includes a projected end portion inserted in a matching recessed portion.

5. A method for manufacturing an electrical connector comprising:

bending a metal plate and bringing both ends of the metal plate into contact with each other to thereby form a cylindrical metal shell which is penetrated in a back-and-forth direction to allow a mating connector to be inserted therein from a front thereof;

sealing an outer peripheral joint of a lengthwise mating portion extended from an open front end of the metal shell to an opposite open rear end of the metal shell to some midpoint from an outer peripheral surface of the metal shell toward an inner peripheral surface of the metal shell;

sealing only a partial portion of an inner peripheral joint of the lengthwise mating portion from the inner peripheral surface toward the outer peripheral joint to thereby form a blocking portion including the portion of the inner peripheral joint, the blocking portion sealing the lengthwise mating portion in an entire plate thickness direction at only the blocking portion, thereby allowing for preventing a flow of a liquid on the lengthwise mating portion from a front end side to a rear end side; and inserting a housing configured to hold an electrically conductive contact into the metal shell, so that an inner sealing member hermetically seals between the housing into which the metal shell has been inserted and the metal shell, and the inner sealing member is brought into contact with the blocking portion.

6. The method for manufacturing an electrical connector according to claim 5, wherein the lengthwise mating portion is irradiated with a laser beam from outside the metal shell to seal the lengthwise mating portion to some midpoint from the outer peripheral surface to the inner peripheral surface, and the lengthwise mating portion is irradiated with a laser beam from inside the metal shell and from back to form the blocking portion.

7. The method for manufacturing an electrical connector according to claim 5, further comprising:

inserting a projected end portion of the metal plate into a matching recessed portion of an opposite edge of the metal plate to form a lengthwise mating portion.

8. The method for manufacturing an electrical connector according to claim 7, wherein:

the lengthwise mating portion is irradiated with a laser beam from outside the metal shell to seal the lengthwise mating portion to some midpoint from the outer peripheral surface to the inner peripheral surface, and the lengthwise mating portion is irradiated with a laser beam from inside the metal shell and from back to form the blocking portion.

* * * * *